US010309048B2

(12) United States Patent
Lim et al.

(10) Patent No.: US 10,309,048 B2
(45) **Date of Patent: *Jun. 4, 2019**

(54) METHOD OF CHEMICAL TREATMENT FOR FIBERS

(71) Applicant: Tintoria Piana U.S., Inc., Cartersville, GA (US)

(72) Inventors: Sang-hoon Lim, Kennesaw, GA (US); Andrea Piana, Atlanta, GA (US)

(73) Assignee: TINTORIA PIANA US, INC., Cartersville, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/893,801

(22) Filed: Feb. 12, 2018

(65) Prior Publication Data

US 2018/0163332 A1 Jun. 14, 2018

Related U.S. Application Data

(60) Division of application No. 15/062,580, filed on Mar. 7, 2016, which is a continuation of application No. 14/082,596, filed on Nov. 18, 2013, now Pat. No. 9,334,597.

(60) Provisional application No. 61/900,738, filed on Nov. 6, 2013.

(51) Int. Cl.

| | |
|---|---|
| ***D06B 5/10*** | (2006.01) |
| ***D01G 99/00*** | (2010.01) |
| ***D06B 15/10*** | (2006.01) |
| ***D06F 29/02*** | (2006.01) |

(52) U.S. Cl.

CPC ..... *D06F 29/02* (2013.01); *D01G 99/00* (2013.01); *D06B 5/10* (2013.01); *D06B 15/10* (2013.01)

(58) Field of Classification Search

CPC . D06B 3/20; D06B 15/10; B05D 1/38; B05D 3/02; B05D 3/00

See application file for complete search history.

(56) References Cited

U.S. PATENT DOCUMENTS

| | | | | |
|---|---|---|---|---|
| 4,463,048 | A * | 7/1984 | Dickson | D04H 1/00 156/62.8 |
| 6,837,452 | B2 * | 1/2005 | Dezutter | D21F 1/66 162/201 |
| 7,211,293 | B2 * | 5/2007 | Piana | D06M 11/82 106/15.05 |
| 9,334,597 | B1 * | 5/2016 | Lim | D06B 15/10 |
| 2017/0362406 | A1 * | 12/2017 | Li | B29B 17/00 |

* cited by examiner

*Primary Examiner* — Gregory R Delcotto
*Assistant Examiner* — Preeti Kumar
(74) *Attorney, Agent, or Firm* — W & C IP

(57) ABSTRACT

Repeatable and reliable chemical treatment for loose fibers is achieved by spraying or immersing loose fibers in a chemical treatment bath, and continuously moving the soaked fibers through a continuous centrifuge. The continuous centrifuge controls the wet pickup of the chemical formulation on the fibers and assures a substantially even chemical distribution on the centrifuged fibers. The centrifuged fibers may be dried to fix the chemicals in the chemical formulation to the fibers and/or to remove water from the chemical formulation. Recycling of the chemical formulation from the continuous centrifuge allows for the process to be performed more economically and in a more environmentally friendly fashion.

8 Claims, 1 Drawing Sheet

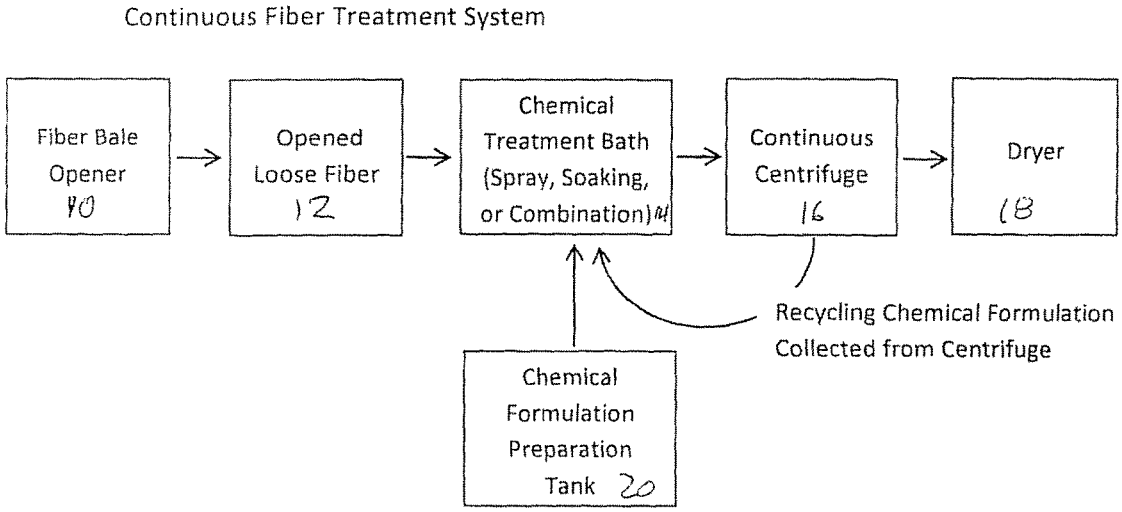
Continuous Fiber Treatment System
Fiber Bale Opener 10
Opened Loose Fiber 12
Chemical Treatment Bath (Spray, Soaking, or Combination) 14
Continuous Centrifuge 16
Dryer 18
Recycling Chemical Formulation Collected from Centrifuge
Chemical Formulation Preparation Tank 20

METHOD OF CHEMICAL TREATMENT FOR FIBERS

CROSS-REFERENCE TO RELATED APPLICATIONS

The application claims priority as a divisional application to U.S. patent application Ser. No. 15/062,580 filed Mar. 7, 2016, and claims priority to and is a continuation of U.S. patent application Ser. No. 14/082,596, filed Nov. 18, 2013, now U.S. Pat. No. 9,334,597, and this application and the prior application claim priority to U.S. Provisional Application 61/900,738 filed on Nov. 6, 2013, the complete contents of which is herein incorporated by reference.

FILED OF THE INVENTION

Aspects for the invention relate to a method of producing chemical-treated fibers using a continuous treatment system. In particular, embodiments of the invention pertain to a method of applying chemicals on loose fibers with substantially even chemical distribution. In some embodiments, chemical formulations collected during the process are sent back to the treatment bath and reused (e.g., recycled for the purpose of protecting the environment, reducing costs, etc.)

BACKGROUND

Textile substrates need various chemical treatments depending on the desired properties of the end-uses. Chemical treatment for textile substrates can be done either by batch or continuous process. For a batch process, a specific amount of textile substrate is treated with chemical formulations for a specific period of time. The amount of chemicals used is normally based on the amount of the substrate being treated or on the amount of formulation being used. In general, in batch processes the exact amount of chemical being used is calculated based on either total amount of the textile substrate or formulation, which is expressed as "% owg (on weight of goods)" or "% owb (on weight of bath)", respectively.

For continuous textile wet processes, textile substrates are treated continuously by being passed through one or more process steps arranged in tandem. Textile substrates pass through a chemical formulation in a treatment bath and the completely soaked substrates pass through a pair of squeeze rolls to remove excess amounts of the formulation in order to control the amount of chemical formulation on the substrates. Then, the substrates continue to pass through a drying (e.g, heating) stage, such as an oven, to remove residual water and to fix the chemicals on the substrates. The amount of chemicals applied on textile substrates depends on the concentration of chemicals in the formulation and the "wet pickup". Wet pickup is the amount of the chemical formulation picked up by the substrate and is expressed as a percentage on weight of the dry substrate. The wet pickup on the substrate is controlled by the nip pressure of the squeeze rolls. To give uniform chemical distribution throughout or over the substrate, the wet pickup must be controlled evenly across the width and along the length of the substrate.

Most chemical treatments for textile substrates are performed at the "fabric stage" (e.g., a stage where the fabric has already been produced from fibers). However, chemical treatments are also performed at the "fiber stage" (e.g., when chemical-treated fibers are required for yarn spinning or nonwoven production). For a batch process chemical treatment of fibers, a specified amount of loose fibers is loaded in a perforated basket, and the basket is loaded into a chemical treatment device such as a stock dyeing machine. After loading the basket, a specific amount of chemicals is applied on the fibers using the dyeing machine or other chemical treatment device for a specified period of time. In contrast, in a continuous process, the fibers in a web or batt form are continuously passed through one or more process steps arranged in tandem. The wet pickup control for the fibers is difficult in a continuous process when compared to woven fabrics because the thickness of the fiber web (or batt) is generally uneven across the width and along the length.

If, in a continuous process, the fibers were subjected to scouring, bleaching, and rinsing, the fibers will contain only water after final squeezing. In this case, even though there will be a variation of wet pickup on the fibers, this will generally not pose a problem since there will be no remaining chemical on the fibers after drying. In sharp contrast, when the fibers are subjected to chemical formulation treatment, the wet pickup variation will cause uneven chemical distribution throughout the final dried fibers. This will cause an uneven quality (property) on the final products (yarn or nonwoven) made with these fibers.

U.S. Pat. Nos. 4,213,218, 4,425,842, and 4,944,070, each of which are herein incorporated by reference, describe methods of continuous wet finishing for fibers. These applications require the loose fibers to be converted into a web or batt form before the wet treatment. These applications utilize a squeezing system to control final chemical amount on the treated fibers. In operation, the fiber web (or batt) soaked with a chemical formulation is passed through a pair of squeeze rolls. The amount of the chemical formulation picked up by the fibers is controlled by the pressure of the squeeze rolls. However, in practice, the squeezing system does not provide an even chemical distribution on the final treated fiber because the thickness of the fiber web (or batt) squeezed is not even. The thickness of fiber web (or batt) is much less controllable compared to the thickness of woven fabrics.

SUMMARY

The invention pertains to continuous chemical treatment systems for fibers, and particularly provides a process and system for the continuous chemical treatment of loose fibers which ensures substantially uniform chemical distribution on the treated fibers (e.g., the wet pick up of the chemical chemical formulation from fiber to fiber varies by 10% or less, and more preferably 5% or less for wetted fibers; using squeeze alone typically results in variations of 50% or 100% or more).

An embodiment of the invention is to utilize a continuous centrifuge to control chemical formulation wet pickup on the fibers.

Another embodiment of the invention is to recycle the chemical formulation collected from the centrifuge to provide advantages such as lowering production costs and providing a more environmentally friendly process, etc.

Continuous centrifuges are used in many different industries, such as food, fine chemical, pharmaceutical, and textile industry. For example, continuous centrifuges are used in the textile industry to dewater wet textile fibers. The excess amount of water from bleached or dyed loose fibers from a dyeing machine needs to be removed before drying. Normally the amount of water on bleached cotton fibers, for example, is around 200~400% on weight of the dried fiber.

These wet cotton fibers cannot be dried without removing the excess amount of the water. Prior to this invention, continuous centrifuges were used for dewatering, and the present invention allows for control of the application of chemical formulation to fibers.

It has now been demonstrated herein that loose fibers which have been subjected to a chemical treatment bath (e.g., one that applies fire retardant chemicals, antimicrobials, insect repellants, etc., via a spray or soaking operation), can advantageously be passed through a continuous centrifuge to render the fibers to have a substantially even chemical distribution. That is, in the process chemically treated fibers from a chemical treatment bath are fed into an inlet of the centrifuge continuously and the fibers are released from the outlet of the centrifuge continuously have a substantially even chemical distribution within or on the surface of the fibers (e.g., the wet pick up of the chemical formulation from fiber to fiber varies by 10% or less, and more preferably 5% or less). Often, but not always required, the fibers released from the outlet will be dried in a dryer (e.g., oven or other drying apparatus). The processing proposed herein allows for continuous processing of fibers by ensuring application of chemicals on loose fibers with substantially even chemical distribution such that the fibers produced will have substantially uniform properties. In some embodiments, chemical formulations collected during the process are sent back to the treatment bath and reused (e.g., recycled for the purpose of protecting the environment, reducing costs, etc.)

DESCRIPTION OF THE DRAWINGS

FIG. 1 is a schematic flow diagram that shows a continuous chemical treatment system for loose fibers.

DETAILED DESCRIPTION

The process of the present invention is intended to produce chemical-treated fibers in the most efficient and economical way as well as to produce the fibers with uniform quality in terms of chemical distribution on the fibers. An exemplary process which exploits the present invention is illustrated schematically in FIG. 1.

Fibers are provided at the beginning of the process, for example as a bale form. The fibers can be natural fibers, man-made fibers, or combination of those. Natural fibers include, but are not limited to, cotton, ramie, coir, hemp, abaca, sisal, kapok, jute, flax, linen, kenaf, coconut fiber, pineapple fiber, wool, cashmere, and silk. Man-made fibers include, but are not limited to, polyester, nylon, acrylics, acetate, polyolefins, melamin fibers, elastomeric fibers, polybenzimidazole, aramid fibers, polyimide fibers, modacrylics, polyphenylene sulfide fibers, oxidized PAN fiber, carbon fibers, novoloid fibers, manufactured cellulosic fibers (e.g., rayon, lyocell, bamboo fiber, Tencel®, and Modal®), and manufactured FR cellulosic fibers (e.g., Visil®, Anti-Fcell®, Daiwabo's FR Corona® fibers, Anti-Frayon®, Sniace's FR rayon, and Lenzing Fir).

A conventional fiber opener 10 can be used to open a chunk of compact fibers from a bale into a loose fiber form and spread the opened loose fibers 12 on a conveyer belt or other apparatus which carries the fibers to the next step of the process. A fine opener may be used for better opening of the fibers. A continuous layer of the opened loose fibers is moved into and through a treatment bath 14 containing a chemical formulation (one or more chemicals; both aqueous and non-aqueous formulations being a chemical formulation according to the invention; however, water alone (i.e., without one or more chemicals) not constituting a chemical formulation according to the invention) and the fibers are completely soaked by the chemical formulation to produce treated loose fibers. For the fibers that need a longer time to be wet, the chemical formulation may be sprayed on the fibers before immersing them into the chemical formulation in the treatment bath 14. Spraying may also occur after exit of the fibers from the immersion at the bath 14. For the fibers that are relatively easy to be wet, exposure to the chemical spray in the system may be enough, and immersion may not be required. In some embodiments, a spraying system may be installed at the treatment bath 14 and the chemical formulation is supplied either from the bath 14 or a chemical formulation preparation tank 20. When the spraying system is a part of the treatment bath 14, excess amounts of chemical formulation sprayed on the fibers can be automatically collected in the treatment bath 14.

During the chemical formulation treatment, the fibers preferably are stationary (i.e., fibers do not move freely in the chemical bath 14). One exemplary method to make fibers generally not to be floated or not to be tumbled in the treatment bath 14 is to utilize two perforated conveyer belts to hold fibers during the chemical treatment. In this case, the fibers are held between, for example, two perforated endless conveyer belts. Such a system prevents the fibers from floating in the bath 14. This is advantageous since lost fibers left in the bath 14 will cause process issues, such as clogging draining system and sticking inside parts of the treatment bath system. The treatment bath 14 preferably includes a temperature control system to provide a specified temperature when exposing the fibers to the chemical formulation. The specified temperature may be varied depending on the requirements of different chemical formulations.

The soaked, treated loose fibers obtained after immersion or spraying or both in the chemical treatment bath 14 are squeezed by passing through a pair of squeeze rolls to remove excess amounts of chemical formulation to prevent dripping of the chemical formulation from the fibers while the fibers move to next step of the process. Preferred wet pickup after the squeeze rolls is around 200~300%. But it will vary depending on type of fibers. In an environmental friendly embodiment and cost saving, the squeezed chemical formulation is collected into the treatment bath 14 to be reused for the continuous treatment. For this purpose, the squeeze rolls may preferably be a part of the treatment bath 14 and may be located at the end of the treatment bath 14, so the squeezed chemical formulation is automatically collected into the bath 14.

Then the squeezed fibers are moved to a continuous centrifuge 16 to remove additional chemical formulation from the fibers, and to control chemical formulation wet pickup on the fibers and to achieve a substantially even chemical distribution within or on the surface of the fibers. At this step, a conventional fiber opener and fiber distributer may be used to supply better opened fibers and controlled amount of fibers to the continuous centrifuge. The centrifugation step controls the final wet pickup of the chemical formulation on the fibers. Preferred wet pickup after the centrifugation is below 100% and more preferably at 50~80%, but the final target wet pickup can be varied depending on different type of fibers and their liquid absorption characteristics. For continuous centrifugation, the controlled amount of squeezed fibers is fed into an inlet of the centrifuge continuously and centrifuged fibers are released through an outlet of the centrifuge continuously. The centrifuged fibers released from the outlet of the centrifuge will have substantially even chemical distribution (e.g., a variance of the wet pickup of the chemical formulation of less than 10% from fiber to fiber) such that the fibers produced will have substantially uniform properties. The continuous centrifuge system may include a cyclone and a feeder whereby fibers released from the continuous centrifuge are transferred to a cyclone to remove air flow from the fibers such that at the feeder supply a uniform layer of chemical-treated loose fibers is provided to a dryer continuously.

During the continuous centrifugation, extracted chemical formulation from the fibers may be collected and continuously sent to the treatment bath 14 (or a chemical formulation preparation tank 20) for reuse. At the same time a fresh chemical formulation from one or more chemical formulation preparation tanks 20 can be continuously supplied to the treatment bath 14 to replenish the depleted amount of the chemical formulation by fiber treatment and to keep a same level of the chemical formulation in the bath 14.

The fibers released from the outlet of the continuous centrifuge 16 may be transferred to a conventional fiber dryer 18 continuously. This may be accomplished by first passing the released fibers from the centrifuge 16 through a cyclone and a feeder. A drying step advantageously removes residual water from the fibers and may assist in fixing chemicals on the fibers. The dried chemical-treated fibers may then be baled to be sent to further processes, such as yarn spinning or nonwoven production.

Exemplary chemicals which may be used for the treatment include but are not limited to softeners, hydrophilic agents, hydrophobic agents, water/oil repellents, anti-static agents, soil-release agents, spin finishes, flame retardants, antimicrobials, insect-repellents, UV absorbers, odor absorbers, fragrances, etc. In addition, a plurality of different chemicals (e.g., flame retardants and hydrophobic agents) or different types of chemicals within one category (e.g., two or more antimicrobials) could be used in the treatment.

A particular advantage of the present invention from prior art is that it permits continuous fiber treatment to be performed uniformly. That is, by utilizing a continuous centrifuge, the wet pickup of chemical formulation on the fibers is reliably and reproducibly controlled. This system and process provides for more precise control of wet pickup compared to squeezing system employed by the prior art. Also, the present invention does not require converting the fibers into a web or batt form as required in the prior art. That is, simply opened loose fibers can be treated with the system of the present invention.

While the present invention has been described in terms of preferred embodiments, those skilled in the art will recognize that the invention can be practiced with considerable modification within the spirit and scope of the appended claims.

What is claimed is:

1. A method for continuous chemical treatment of loose fibers, comprising the steps of:

applying a chemical formulation to loose fibers as the loose fibers continuously move through a chemical treatment bath, wherein said step of applying is performed by one or more of spraying the chemical formulation on the loose fibers and immersing the loose fibers in the chemical formulation;

continuously conveying the loose fibers through the chemical treatment bath, wherein the loose fibers are held stationary during passage through the chemical treatment bath; and then centrifuging, with a continuous centrifuge, the loose fibers with applied chemical formulation received from the chemical treatment bath to produce centrifuged loose fibers with the chemical formulation evenly distributed on the loose fibers.

2. The method of claim 1 further comprising the step of squeezing the loose fibers prior to said step of centrifuging.

3. The method of claim 1 further comprising the step of drying the centrifuged fibers.

4. The method of claim 1 wherein the step of applying is performed by spraying the loose fibers with the chemical formulation.

5. The method of claim 1 wherein the step of applying is performed by immersing the loose fibers in the chemical formulation.

6. The method of claim 1 further comprising the step of recycling chemical formulation from the continuous centrifuge to said chemical treatment bath.

7. The method of claim 1 further comprising the step of supplying a portion of said chemical formulation to the chemical treatment bath from a chemical formulation preparation tank.

8. The method of claim 1 wherein holding the loose fibers stationary is performed by holding the loose fibers against one or more conveyors.

* * * * *